United States Patent [19]

Hasegawa

[11] 4,427,043

[45] Jan. 24, 1984

[54] CORD BURYING APPARATUS FOR VENEER LATHE

[75] Inventor: Katsuji Hasegawa, Ohbu, Japan

[73] Assignee: Meinan Machinery Works, Inc., Aichi, Japan

[21] Appl. No.: 241,132

[22] Filed: Mar. 6, 1981

[30] Foreign Application Priority Data

Mar. 23, 1980 [JP] Japan ..... 55-37926

[51] Int. Cl.[3] ..... B27C 5/02

[52] U.S. Cl. ..... 144/209 R; 144/213; 144/365

[58] Field of Search ..... 144/2 R, 209 R, 211, 144/212, 213, 365, 344

[56] References Cited

U.S. PATENT DOCUMENTS 4,289,179 9/1981 Koba ..... 144/211

*Primary Examiner*—W. D. Bray

[57] ABSTRACT

A cord burying apparatus for a veneer sheet is provided. The apparatus comprises a cord burying knife and a piercing element having a plurality of piercing members thereon and provided on one side of the cord burying knife in axial juxtaposition therewith relative to the log. The cord burying knife has an edge facing upstream with respect to the log rotation to come into a cutting engagement with the log. The piercing members on the piercing element also come into cutting engagement with the log to positively move the log past the knife. The provision of the piercing element facilitates cutting operations of a log having rotten portions.

3 Claims, 2 Drawing Figures

CORD BURYING APPARATUS FOR VENEER LATHE

BACKGROUND OF THE INVENTION

The present invention relates to an improvement in or relating to an apparatus associated with a veneer lathe for cutting slits in the surface of a log turning perpendicular to its grain and, at the same time, burying a string or cord in the slits in the log.

Prior art apparatuses of the type described are disclosed in Japanese Patent Publications No. 49-6642, No. 35-4246 and No. 49-32052. All of these known apparatuses employ a cutting and cord burying element or knife which has a cutting edge oriented to face the upstream side of the moving surface of a log and is positioned so as to permit a determined depth of penetration of the cutting edge into the log. The knife forms cuts or slits on the surface of the log perpendicular to the grain and embeds in the slits a cord which will be fed out from an opening located at the tip of the knife. The cord will reinforce the surface of the log before the log is turned into a sheet of veneer. This slitting and cord burying operation may be carried out, if desired, on a veneer sheet cut off from a log for joining purposes.

Each such apparatus achieves an outstanding effect and, indeed, its practical use on an industrial scale is anticipated provided acceptable logs without cracks or rotten spots are supplied. Nevertheless, none of them have heretofore been put to practical use because they are unsuitable for reinforcing or joining purposes when logs have numerous cracks and/or rotten areas and, therefore, have a greater need for reinforcement or joining. This mainly results from the fact that the wood splits off or becomes ready to aplit due to the cracks and rotten areas in positions adjacent to the knife and tends to pack itself around the knife and break the cord. The larger the number of cracks and rotten areas in the log, the greater the tendency for such an occurrence. If the cord thus breaks or, if not broken, lifts itself out of the slits in a log or a veneer sheet, the operation will only damage the surface of the log or a veneer sheet and negate the intent to reinforce it.

It will be seen from the above that, unlike the known marking technique intended only for cutting purposes using a marking knife, the cord burying technique on a veneer lathe works in a way which produces a practically opposite effect, when an accident occurs in the neighborhood of the cord burying knife. Every time this occurs, the cutting operation on the veneer lathe must be suspended and the cord must be threaded, through the knife, a time consuming job. This significantly limits the log turning rate which constitutes a major function of a veneer lathe.

SUMMARY OF THE INVENTION

It is an object of the present invention to provide an improved cord burying apparatus free from the drawbacks inherent in the prior art apparatuses as discussed, paying particular attention to a structural part of a log or that of a veneer sheet adjacent to the surface. A cord burying apparatus according to the present invention includes a suitably shaped and located cutting and cord burying element such as those shown in the aforementioned Japanese Patent Applications or one shown in the present applicant's Japanese Patent Application No. 53-137098 filed on Nov. 6, 1978. The apparatus also includes a movable piercing element adapted to hold a surface portion of the wood adjacent to the cord burying element in a solid manner thereby firmly constraining said surface portion and positioned to at least one side of the cord burying element in integral coordination therewith. This apparatus can favorably reinforce or join sheets despite the current supply of logs which is far poorer in quality than those which were available at the time when the technique of the aforesaid prior art was proposed.

DETAILED DESCRIPTION OF THE PREFERRED EMBODIMENTS

Figure 1:
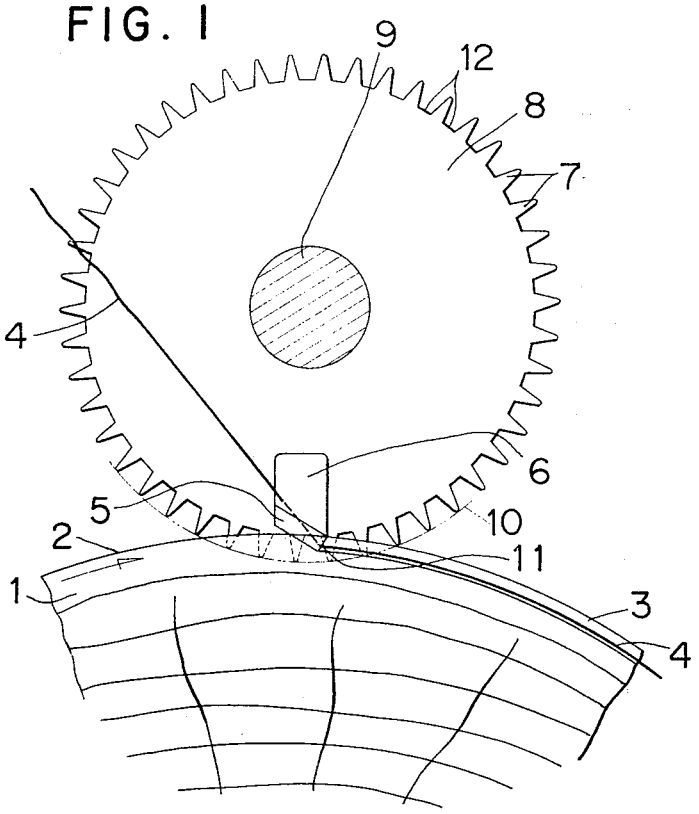
FIG. 1 shows in side elevation a cord burying apparatus according to the present invention.
Figure 2:
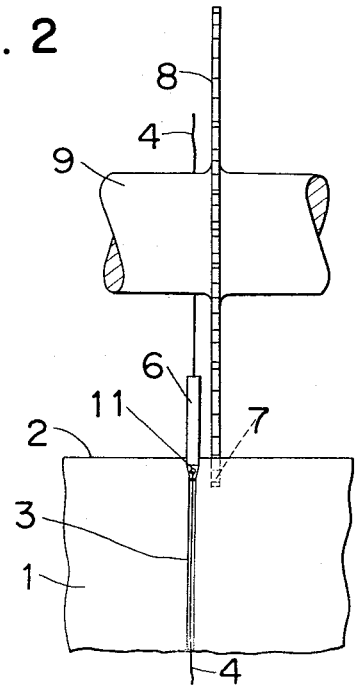
FIG. 2 is a front view of the apparatus shown in FIG. 1.

Referring to FIGS. 1 and 2, there is shown a cord burying apparatus according to the present invention which is attached on and cooperates with a conventional veneer lathe (not shown). The reference numeral 1 denotes a log having a surface 2 and rotating in the direction indicated by an arrow to be turned on the veneer lathe. The apparatus includes a cutting and cord burying element or knife 6 having a cutting edge 5 and an opening 11 at the trailing end of edge 5 to guide a cord 4 out from the element 6. The knife 6 is held by a suitable retaining member (not shown) with its edge 5 facing upstream with respect to the moving direction of the log 1 and such that the edge 5 comes into cutting engagement with the log to a predetermined depth to form cuts or slits 3 in the log while embedding the cord 4 in the slits 3. This assembly constitutes a basic part of the cord burying apparatus. A movable piercing element 8 has numerous spaced piercing members along its circumference and is located to one side of the knife 6 at a certain short distance in axial juxtaposition therewith relative to the log. A shaft 9 carries the piercing element 8 therewith and may be adapted for free running and driven for rotation by the log through the element 8 or by a suitable drive mechanism held in driving connection with the shaft 9. An additional similar piercing element may be mounted on the shaft 9 at a spaced location from the element 8 if necessary. A condition essentially here is that the piercing members 7 on the element 8 cut into the log 1 and move in synchronism with the log 1. Apart from the illustrated disc, a suitable endless strip having numerous piercing elements thereon may be employed as the piercing element 8. The piercing element 8 is related with the knife 6 such that on one side of the knife 6 the piercing element 8 cuts deeper into the log than the knife 6 and the tips of its piercing members 7 draws a locus 10 which encloses the knife 6 positioned within the log 1 as viewed in the axial direction of the log. Stated another way, the piercing element 8 engages not only with the surface but to a certain depth of internal structure of the log which contains the knife 6 thereinside and, in this way, constrains a surface portion of the log around the knife 6 in a solid manner. This is unachievable with a simple pressing roller heretofore made use of. The piercing element has a coordinative and integral relation with the knife 6.

In operation, the piercing members 7 at the periphery of the element 8 penetrate into a surface portion of the log 1 adjacent to and upstream of the knife 6 and permits the portion to reach the knife 6 while firmly constraining it despite possible cracks or rotten areas. Then the piercers 7 cut further into the internal structure of the log 1 to keep the surface portion concerned under constriction at a position where the knife 6 forms a slit in the log 1 and buries a cord in the slit. At a position downstream of the knife 6, the piercers 7 still engaged with the log 1 ensure smooth passage of the surface portion of the log clear of the knife 6. It will thus be appreciated that the knife 6 can successfully bury a cord even in defective logs now supplied without reducing the operating rate of a veneer lathe. Conventionally, such reinforcement or connection has had no future due to cut-off or lift-off of the cord which occurs almost every time a defective part of the log moves past a cord burying knife. The apparatus according to the present invention can be put to practical use with ease and can accommodate the known combined use of an adhesive and a cord. Even when a log has cracks thereon which are relatively wide at the log surface, the apparatus of the invention can join it together without the need for treating such cracks. This particular effect ensures quite stable joining using a cord and thereby produces a neat arrangement of veneer sheets cut off from a log.

The piercing element 8 is preferably located at a position which is suitably close to the knife 6 in the axial direction of the log. Also, the piercing element 8 is preferably retained integrally with the knife 6 so as to maintain a constant relation between the penetratable depths thereof into the log. If necessary, means may be located adjacent to the knife 6 for limiting the penetrable depths of the elements 8 and 6 while exerting a pressure force onto the log surface. A possible form of such means may be root surfaces 12 on the element 8 interconnecting neighboring piercers 7 as viewed in FIG. 1 or a suitable presser roller such as a rubber roller.

It will be noted that the coordinative and integral arrangement of a movable piercing element and a cord burying element described hereinabove may be designed to process a veneer sheet laid on a suitable feed mechanism with a view to minimizing the troubles discussed above.

What is claimed is:

1. A cord burying apparatus for a veneer lathe comprising:

a cord burying knife having a cutting edge of suitable shape and a cord outlet at one end thereof, said knife being attached on a veneer lathe to come into cutting engagement with a log turned on the veneer lathe to a predetermined depth; and a piercing element placed on at least one side of said cord burying knife in axial juxtaposition therewith relative to the log and having a plurality of piercing members mounted thereon in a row which intersect an axial direction of the log, said piercing member having means thereon being adapted to pierce the log deeper than the knife.

2. A cord burying apparatus according to claim 1, wherein said piercing element includes a disc-shaped member.

3. A cord burying apparatus according to claim 2, wherein said disc-shaped member is adapted for free running and driven by log rotation.

* * * * *